United States Patent [19]

Manning

[11] 3,990,579

[45] Nov. 9, 1976

[54] CONTACT LENS HOLDING UNIT

[75] Inventor: Wayne R. Manning, Victor, N.Y.

[73] Assignee: Bausch & Lomb Incorporated, Rochester, N.Y.

[22] Filed: June 30, 1975

[21] Appl. No.: 590,223

[52] U.S. Cl. ..... 206/501; 134/137; 206/205

[51] Int. Cl.[2] ..... A45C 11/04; B65D 81/24

[58] Field of Search ..... 134/137, 143; 206/5.1, 206/328, 334, 521, 205, 525

[56] References Cited

UNITED STATES PATENTS

| | | | |
|---|---|---|---|
| 3,298,502 | 1/1967 | Schwartzman | 206/501 |
| 3,552,548 | 1/1971 | Wallestad et al. | 206/328 |
| 3,672,495 | 6/1972 | Bauer et al. | 206/328 |
| 3,770,113 | 11/1973 | Thomas | 134/143 X |
| 3,822,780 | 7/1974 | Ulmer et al. | 134/137 X |
| 3,880,278 | 4/1975 | Brown | 206/501 |

*Primary Examiner*—Steven E. Lipman
*Attorney, Agent, or Firm*—Frank C. Parker; DeWitt M. Morgan

[57] ABSTRACT

A contact lens storage unit which is formed of first and second mating members. On one of these members, which may be the cap of the lens storage unit, a dome-like contact lens supporting element is provided. A cover, having a concave surface which cooperates with the dome-like contact lens supporting element to encage a contact lens is also provided. Finally, the unit includes a raised annular ring disposed about the dome-like contact lens supporting element. Complementing threads provided on both members and a seal complete the lens storage unit.

7 Claims, 2 Drawing Figures

CONTACT LENS HOLDING UNIT

CROSS-REFERENCES TO RELATED APPLICATIONS

This application is cross-referenced to design application Serial No. 490,537 of Paul A. Hoogesteger and to U.S. Pat. No. Des. 237,416 of Paul A. Hoogesteger and John Kadlecik. This application is also cross-referenced to application Ser. No. (590,222) which is a continuation of application Ser. No. 490,535 now abandoned.

BACKGROUND OF THE INVENTION

This invention relates to containers for storing contact lenses which may be of either a hard or a soft composition.

It is well known that hard contact lenses have been used in the industry for years. However, in recent years a relatively new contact lens has been introduced to the market that is produced from a soft, pliable material which is hydrophilic in nature.

It will be appreciated that proper care of these contact lenses is necessary to preclude any contamination which may be caused by foreign substances being absorbed into, or carried by, the lens. Accordingly, it is imperative that the user of soft contact lenses be provided with means to disinfect such lenses. Therefore, it is generally recommended that a complete and effective cleansing of the soft plastic contact lenses must be carried out on a regular basis. One general way to cleanse the soft plastic contact lenses, is to place them in a first closure which contains a saline solution that is compatible with the fluid constituents found in the human eye. This first closure may then be placed in a second vessel of water which is brought to the boiling point so that the soft contact lenses inside the first closure are properly cleansed.

It is well known that there are many different types of containers available in the marketplace which are intended for use in storing and carrying contact lenses. In the case of soft contact lenses, these containers, which may be subjected to heat during a cleansing process, are generally rather large and bulky. Also, such prior art soft contact lens containers were generally complicated in construction.

SUMMARY OF THE INVENTION

A contact lens holder includes a support member and a dome-like contact lens supporting element secured thereto. The holder also includes a cover which is pivotally connected to the support member. The cover includes a concave shaped surface which cooperates with the contact lens supporting element to encage a lens. Finally, the lens holder includes a raised annular ring disposed about the lens supporting element. The annular ring and lens supporting element define a liquid retaining reservoir when the lens supporting element is in an upright position support member may be a cap which cooperates with a second member to form a contact lens storage unit.

DETAILED DESCRIPTION OF THE PREFERRED EMBODIMENTS

Figure 1:
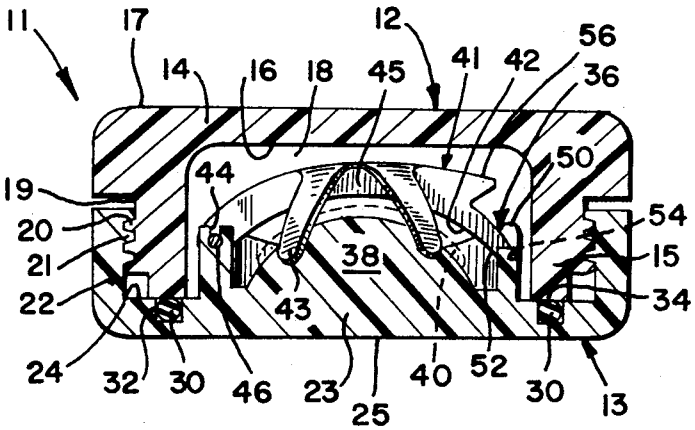
FIG. 1 is a cross-sectional view of the contact lens storage unit.

The contact lens storage unit 11 includes first and second mating parts or members, 12 and 13, respectively. As is evident from inspection of FIG. 1, member 12, defined by base portion 14 and annular ring portion 15, has interior and exterior surfaces 16 and 17 and a generally U-shaped cross-section. Base portion 14 and ring portion 15 define a liquid holding cavity 18. Formed on exterior surface 19 of ring portion 15 are, for instance, external threads 20 which are designed to engage complementing internal threads 21 that are formed on wall portion 22 of mating part 13. Similar to mating part 12, mating part 13, defined by wall portion 22 and base portion 23, includes interior surface 24 and exterior surface 25 and has a generally U-shaped cross-section.

To provide a liquid tight seal between the mating parts 12 and 13 when they are engaged to one another, there is provided a suitable seal, such as is illustrated by O-ring 30. In this instance seal 30 is fitted in an annular groove 32 which is formed in interior surface 24 radially inward from wall portion 22. The O-ring 30 bears against surface 34 provided on ring portion 15 to thereby provide a fluid tight seal between the two mating parts 12 and 13 when they are assembled together.

A continuous raised annular ring 36 is formed on interior surface 24 of mating part 13 just inward from the annular groove 32. Inside the area defined by raised annular ring 36 there is formed a dome-like contact lens supporting element 38. The dome-like element 38 preferably has a spherial curvature and is designed as a pad to accept the concave side of a contact lens, indicated by broken lines 40 in FIG. 1.

Figure 2:
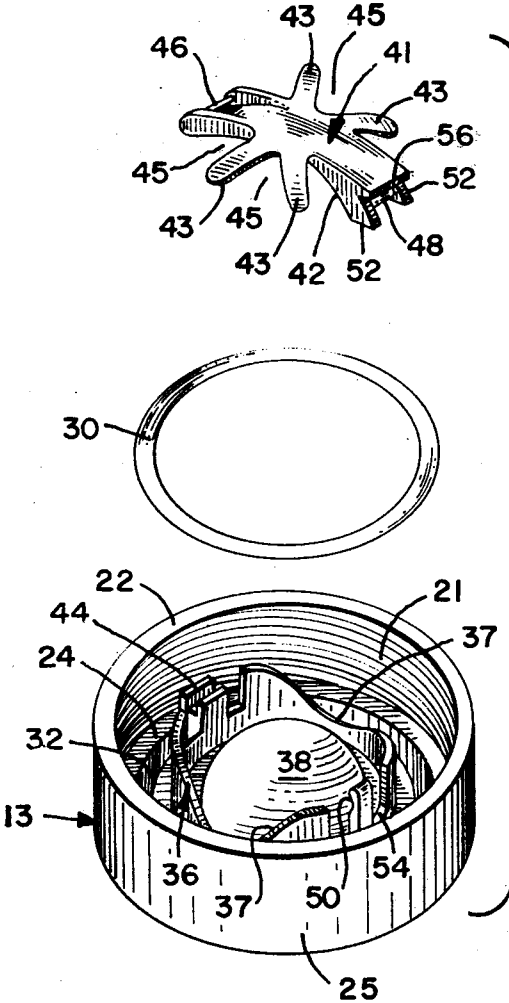
FIG. 2 is an exploded view of a portion of the contact lens storage unit illustrated in FIG. 1.

The lens cover member or cage 41, as best illustrated in FIG. 1, is provided with a concave surface 42 and is pivotably engaged to the raised annular ring 36 at pivot 44 by pivot pin 46. Cover member 41 is also provided with a catch member 48, as best seen in FIG. 2, which engages a detent 50 that is provided in the raised annular ring 36. A pair of legs 52 protrude past the catch member 48 which, when cover member 41 is in the closed position, engage stop surfaces 54 to prevent the catch member 48 from overriding the detent 50. This, in turn, prevents cover 41 from engaging contact lens 40 and damaging it. A tang 56, formed on the concave cover member 41 immediately above the catch 48, aids the user in opening cover 41. Finally, cover 41 may be formed by a plurality of radially extending fingers 43, as shown, which may have openings 45 therebetween. The openings 45 permit easy fluid access to contact lens 40 carried on dome-like element 38. In some instances the user may have some difficulty introducing the contact lens 40 to the dome-like structure 38 because the raised annular ring 36 inhibits easy finger movement. Therefore, the raised annular ring 36 may be provided with relieved areas 37 to make the dome-like structure 38 more accessible.

In order to place contact lens 40 in lens storage unit 11, the user would first disengage member 12 from member 13 and place them in a side by side relationship such that both dome-like element 38 and cavity 18 faced upward. If the cavity 18 is empty and contact lens 40 is manufactured from a hydrophilic material, a predetermined amount of liquid would be introduced into the empty cavity 18. To encage contact lens 40 on member 13, concave cover member 41 is pivoted to its open position, thereby exposing the dome-like element 38. The concave side of a contact lens 40 may then be placed on dome-like element 38. The concave cover member 41 would then be pivoted to its closed position. Thereafter the two mating parts 12 and 13 would be reunited together to form the storage unit 11.

To remove lens 40, lens storage unit 11 would be placed such that cavity 18 faced upward. Member 13 would then be disengaged therefrom and placed in an upright position with dome-like element 38 facing upward. In such a disengaging operation, concave surface 42 of cover 41 would retain a small amount of the liquid held within lens storage unit 11. The retained liquid would spill over lens 40 as member 13 is placed in an upright position and would thereafter be retained by annular ring 36. Such retained liquid would, by contact with the edge portion of lens 40 help prevent lens 40 from drying out in the event that it is not immediately removed from dome-like element 38.

The foregoing is a brief description of the principle embodiment of this invention. However, it will be readily appreciated by those skilled in the art that there are numerous details which may be altered without departing from the spirit or scope of the present invention. For instance, internal 21 and external 20 threads may be switched from one mating part to the other. Dome-like element 38 may be formed on mating part 12 instead of mating part 13. Similarly, O-ring seal 30 may be fitted to mating part 12 instead of mating part 13. The configuration of ring 36 and cage 41 may also be altered without departing from the scope of the instant invention.

I claim:

1. A contact lens holding unit, said unit comprising:

a. support means;

b. a dome-like contact lens supporting element secured to said support means;

c. a cover having a concave shaped surface, said cover pivotally connected to said support means to cooperate with said lens supporting element to encage a contact lens therebetween; and d. a raised annular ring, said ring disposed on said support means and about said lens supporting element and defining with said lens supporting element a liquid retaining reservoir when said lens supporting element is in an upright position, said ring being of a height sufficient to retain enough liquid to contact the edge portion of a contact lens supported on said lens supporting element. ,

2. The lens holding unit according to claim 1, wherein said cover includes radially extending fingers, said fingers defining spaces therebetween to enable liquid to directly contact a contact lens supported on said lens supporting element. .

3. The lens holding unit according to claim 2, wherein said raised annular ring has relieved areas formed therein to provide easy access to a contact lens supported on said lens supporting element.

4. The lens holding unit according to claim 3, wherein said support means is a cap having exterior and interior surface and a U-shaped cross-section.

5. The lens holding unit according to claim 4, wherein said lens supporting element, said cover and said ring are supported on said interior surface.

6. A contact lens storage unit comprising:

a. a first member;

b. a second member cooperable with said first member to form a liquid storage unit;

c. a dome-like contact lens supporting element, said element being supported on one of said first and second members;

d. a cover having a concave shaped surface, said cover being pivotally connected to said one of said first and second members to cooperate with said lens supporting element to encage a contact lens therebetween; and e. a raised annular ring, said ring being disposed on said one of said first and second members and about said lens supporting element and defining with said lens supporting element a liquid retaining reservoir when said lens supporting element is in an upright position, said ring being of a height sufficient to retain enough liquid to contact the edge portion of a contact lens supported on said lens supporting element.

7. The contact lens storage unit according to claim 6, wherein said cover includes radially extending fingers, said fingers defining spaces therebetween to enable liquid held in said liquid storage unit to directly contact a contact lens supported on said lens supporting element, and wherein said raised annular ring has relieved areas formed therein to provide easy access to a contact lens supported on said lens supporting element.

* * * * *

UNITED STATES PATENT AND TRADEMARK OFFICE

CERTIFICATE OF CORRECTION

PATENT NO. : 3,990,579

DATED : November 9, 1976

INVENTOR(S) : Wayne R. Manning

It is certified that error appears in the above-identified patent and that said Letters Patent are hereby corrected as shown below:

column 1, line 60, change "upright position support member" to --upright position. The support member--.

Column 4, line 14, change "surface" to --surfaces--.

Signed and Sealed this

Eighth Day of March 1977

[SEAL]

*Attest:*

RUTH C. MASON
*Attesting Officer*

C. MARSHALL DANN
*Commissioner of Patents and Trademarks*